US012467479B2

(12) United States Patent
Wanczowski

(10) Patent No.: US 12,467,479 B2
(45) Date of Patent: Nov. 11, 2025

(54) ADJUSTABLE FAN WITH A MAGNETIC BASE

(71) Applicant: Stephen Wanczowski, Sussex, NJ (US)

(72) Inventor: Stephen Wanczowski, Sussex, NJ (US)

( * ) Notice: Subject to any disclaimer, the term of this patent is extended or adjusted under 35 U.S.C. 154(b) by 0 days.

(21) Appl. No.: 18/642,850

(22) Filed: Apr. 23, 2024

(65) Prior Publication Data

US 2025/0327466 A1 Oct. 23, 2025

(51) Int. Cl.

| | |
|---|---|
| ***F04D 29/64*** | (2006.01) |
| ***F04D 19/00*** | (2006.01) |
| ***F04D 25/06*** | (2006.01) |

(52) U.S. Cl.

CPC ..... *F04D 29/644* (2013.01); *F04D 19/002* (2013.01); *F04D 25/0673* (2013.01)

(58) Field of Classification Search

CPC .... F04D 19/002; F04D 19/005; F04D 25/026; F04D 25/0666; F04D 25/0673; F04D 25/08; F04D 25/084; F04D 25/086; F04D 25/10; F04D 25/105; F04D 27/008; F04D 29/00; F04D 29/64

See application file for complete search history.

(56) References Cited

U.S. PATENT DOCUMENTS 5,940,980 A * 8/1999 Lee ..... A45D 20/12 392/382
7,471,883 B2 * 12/2008 Seutter ..... F24H 3/0417 34/96
9,303,652 B2 * 4/2016 Prior ..... F04D 29/601

FOREIGN PATENT DOCUMENTS

WO WO-2021223601 A1 * 11/2021 ..... F04D 25/0673

OTHER PUBLICATIONS

WO-2021223601-A1—Translation (Year: 2021).*

* cited by examiner

*Primary Examiner* — Brian P Wolcott
(74) *Attorney, Agent, or Firm* — Gearhart Law LLC

(57) ABSTRACT

The present invention relates to an adjustable fan having a housing, a motor, a battery, and a plurality of fan blades. The fan further includes an adjustable support structure (e.g. gooseneck) to allow the position and direction of the operation of the fan to be readily manipulated. A power source (e.g. lithium-ion battery or other suitable battery) is electrically connected to the motor, and control circuitry is electrically connected to the power source. Additionally, the fan includes a magnetic element configured to removably connect to a magnetic, metallic object. Further, the adjustable fan may include sensors such as a smoke detection sensor or a timer. The adjustable fan provides versatility and convenience by allowing users to adjust the fan's position and attach it to various objects for optimal airflow.

10 Claims, 4 Drawing Sheets

ADJUSTABLE FAN WITH A MAGNETIC BASE

CLAIM OF PRIORITY

This application is a Non-provisional application and claims no priority to any patent or patent application.

FIELD OF THE EMBODIMENTS

The field of the invention and its embodiments relate to a portable fan, and more particularly to a fan powered by a lithium-ion battery and having an adjustable support structure (e.g. flexible gooseneck) connected to a magnetic base.

BACKGROUND OF THE EMBODIMENTS

Previous approaches to adjustable fans have typically involved fixed support structures that limit the range of motion and positioning options for the fan. These fixed support structures often restrict the user's ability to direct airflow in a desired direction or angle. Additionally, these fixed support structures may be cumbersome and difficult to adjust, requiring the user to physically manipulate the fan to achieve the desired position. Another approach to adjustable fans has involved the use of separate components or accessories to attach the fan to an object. These attachments may include clamps, brackets, or other mechanisms that allow the fan to be secured to a surface or object. However, these attachments may be complex, requiring additional assembly steps and potentially limiting the versatility and portability of the fan.

Furthermore, previous adjustable fans have not incorporated control circuitry to provide enhanced functionality and convenience. These fans typically rely on manual controls or switches to adjust the fan speed or airflow direction. This manual control may be inconvenient and may require the user to physically interact with the fan to adjust. However, none of these approaches have provided a comprehensive solution that combines the features described in this disclosure.

The present invention addresses these limitations by providing an adjustable fan with a unique support structure, an attachment element for easy magnetic connection to an object, and control circuitry for enhanced functionality and convenience.

SUMMARY OF THE EMBODIMENTS

In accordance with the principles of the present invention, an adjustable fan having an adjustable support structure made of a resilient material and featuring a magnetic base incorporates several hardware components to achieve its functionalities as well as provide for ease of transport.

Primarily, this fan includes fan blades connected to an electric motor. The electric motor, preferably powered by a lithium-ion battery, converts electrical energy from the battery into mechanical energy to drive the rotation of the blades and create airflow. Ideally this airflow deflects smoke, harmful vapors, airborne particles and other debris away from the user of the fan, ventilating the work environment. The adjustable support structure, typically made from flexible, yet resilient materials like durable plastic or flexible metals, allows users to modify the fan's position and orientation for directing airflow as desired. Integrated sensors, such as a thermometer, smoke detector(s), or timer, serve specific purposes. For example, the thermometer sensor monitors the ambient temperature, while the timer sensor tracks elapsed time, and the smoke detector can alert to the presence of smoke and other airborne contaminants. These sensors contribute to the fan's functionality by enabling temperature-sensitive or time-based operations, enhancing user experience and comfort. A control switch is part of the hardware, providing the means for users to turn the fan on or off and potentially adjust settings, such as speed or operational modes.

The magnetic base contains magnets that deliver a secure attachment to metallic surfaces, ensuring stability and ease of placement on various magnetic surfaces, such as metal construction structures (both buildings and scaffolds), I-beams, scissor lifts, work benches, metal desks, or shelves, and the like or some combination thereof.

The power source for the fan is preferably a lithium-ion battery, known for its high energy density and compact design. This battery stores electrical energy in a chemical form and supplies the necessary power to the fan's electric motor, allowing for portability and wireless operation. Additionally, the fan's hardware includes circuitry responsible for managing power flow, regulating sensor data, and controlling fan operation based on user inputs and sensor readings. This circuitry enables the integration of sensor data into the fan's functionality and ensures safe and efficient use of the lithium-ion battery.

In summary, the hardware components of this fan having an adjustable support structure, magnetic base, integrated sensors (thermometer, smoke detector, timer, etc.), control switch, and powered by a lithium-ion battery, collectively contribute to its versatility, functionality, and portability, offering adjustable airflow and potentially automated operations based on environmental conditions or user preferences, and which also includes improvements that overcome the limitations of prior adjustable fans, is now met by a new, useful, and non-obvious invention.

DESCRIPTION OF THE PREFERRED EMBODIMENTS

Figure 1:
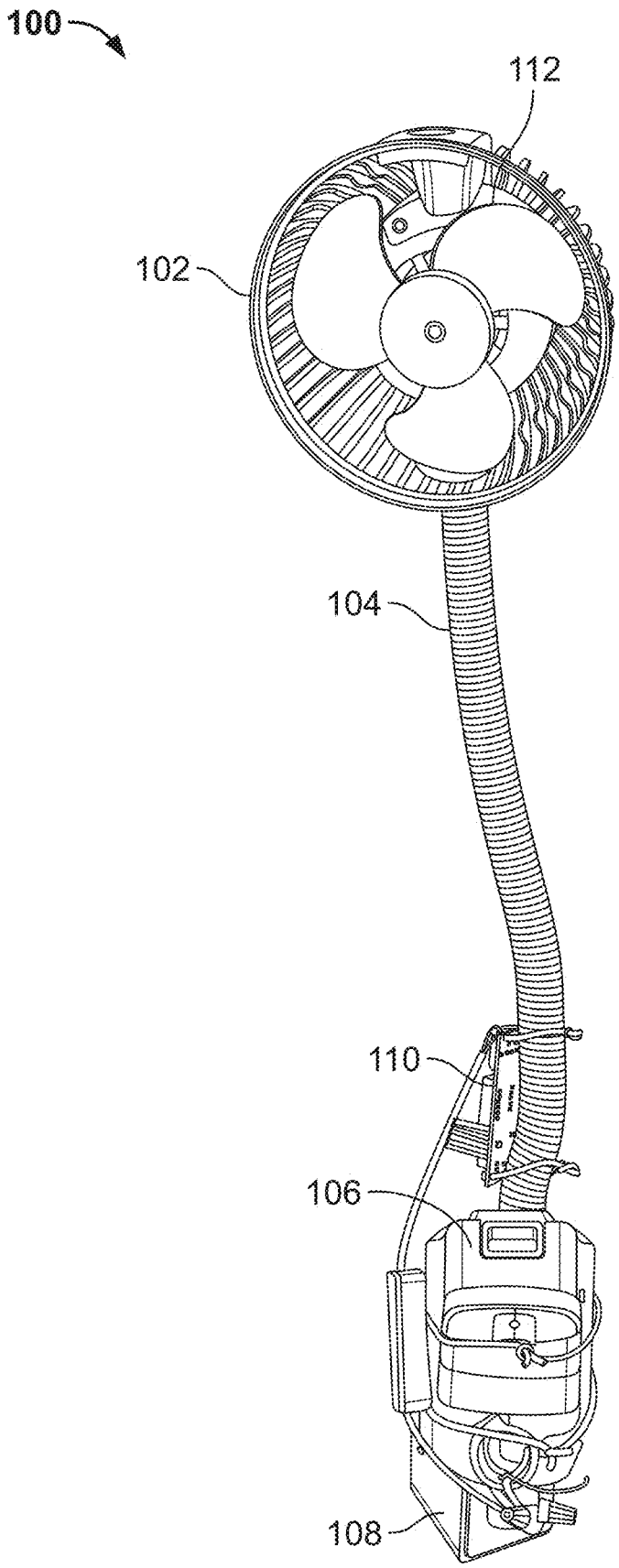
FIG. 1 depicts a front perspective view of an adjustable fan in a substantially upright orientation, according to at least some embodiments disclosed herein.

The preferred embodiments of the present invention will now be described with reference to the drawings. Identical elements in the various figures may be identified with the same reference numerals. Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations may be made thereto.

The phrase "and/or," as used herein in the specification and in the claims, should be understood to mean "either or both" of the elements so conjoined, i.e., elements that are conjunctively present in some cases and disjunctively present in other cases. Thus, as a non-limiting example, a reference to "A and/or B", when used in conjunction with open-ended language such as "comprising" may refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Figure 2:
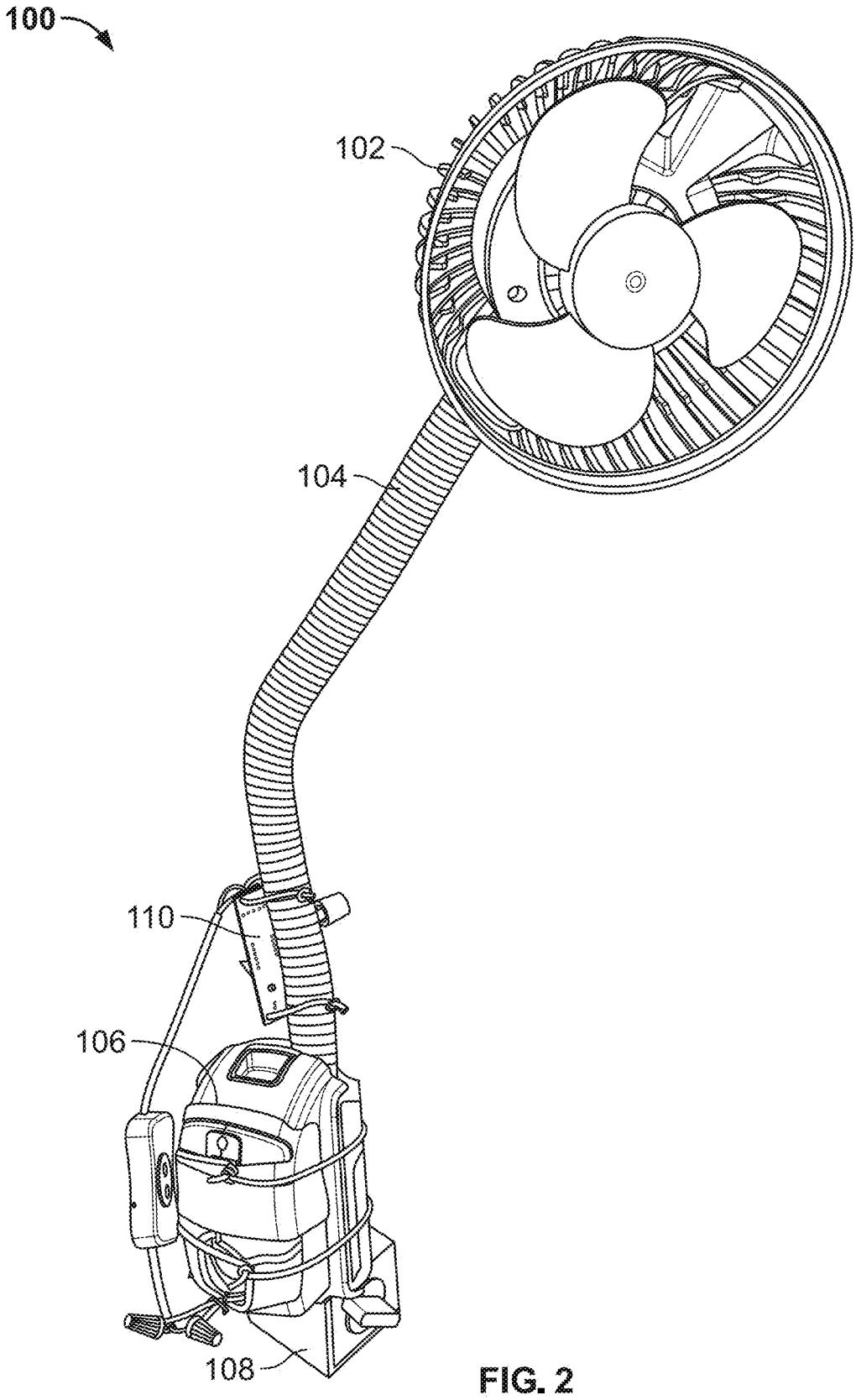
FIG. 2 depicts a perspective view of the adjustable fan of FIG. 1 in a substantially bent orientation, according to at least some embodiments disclosed herein.
Figure 3:
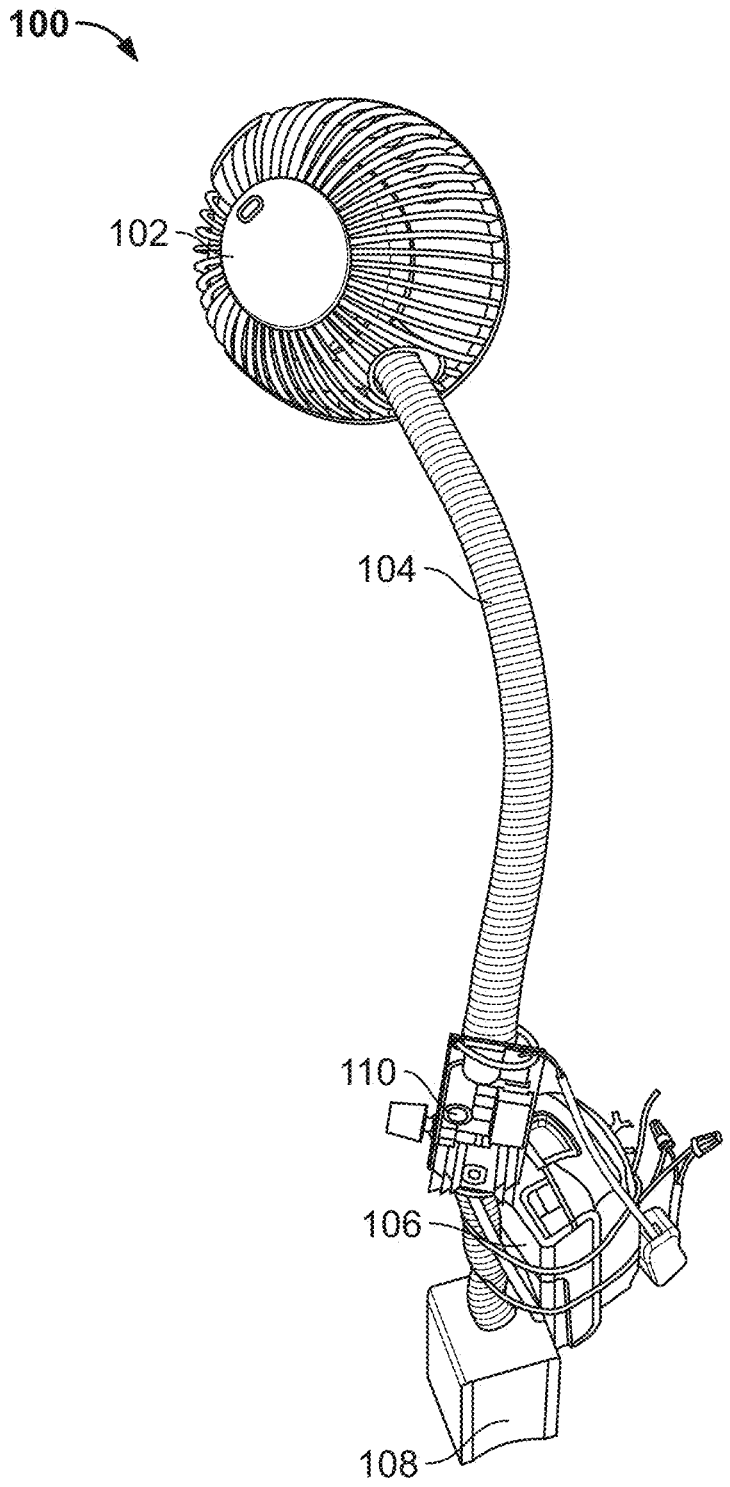
FIG. 3 depicts a rear view of the adjustable fan of FIG. 2, according to at least some embodiments disclosed herein.

FIGS. 1-3 illustrate an adjustable fan 100, including: a housing 102, a motor retained in a motor housing 112, battery 106, a plurality of fan blades, the plurality of fan blades retained in the housing 102. At least a portion of the plurality of fan blades are communicatively coupled to the motor. An adjustable support structure 104 has a first end connected to the housing 102 located opposite a second end connected to the battery 106. Control circuitry 110 is electrically connected to the power source or battery. An attachment element 108 is configured to removably connect to an object. The attachment element 108 includes a magnetic base located on, in some embodiments, a bottom surface of the battery 106.

The control circuitry in the adjustable fan is responsible for overseeing and managing the fan's operations. Comprising various electronic elements such as microcontrollers, integrated circuits, transistors, resistors, and capacitors, this circuitry functions as the central control unit within the fan. Its primary role involves regulating the flow of power from the fan's power source, preferably a lithium-ion battery and in other embodiments another suitable power supply, ensuring that the necessary voltage and current are delivered to different components, including the fan motor. Another essential function of the control circuitry lies in integrating and processing data from sensors embedded within the fan. These sensors, which could include thermometers, smoke detection sensors, humidity sensors, motion sensors, or timers, provide real-time environmental data. The control circuitry interprets this data to make informed decisions about fan operation, such as adjusting speed, changing airflow direction, or activating specific modes based on the sensed conditions.

Moreover, the control circuitry manages the fan's user interface, if present, including buttons, switches, or a display panel. It interprets user inputs and commands, converting them into actions such as turning the fan on/off, modifying speed settings, or engaging different operational modes. Safety features are also embedded within the control circuitry to safeguard the fan and its components. These safety measures might encompass overcharge protection for the battery, temperature monitoring to prevent overheating, or short-circuit protection, ensuring safe and secure fan operation. Additionally, the control circuitry contains programming or logic that dictates the fan's responses under various circumstances. This logic defines how the fan behaves in response to different inputs, allowing it to adapt to changing environmental conditions or user preferences.

In some aspects, the device described herein relates to an adjustable fan, wherein the attachment element is a magnet. The magnetic base in a fan serves as a mounting mechanism, providing a secure and stable attachment to metallic surfaces. It consists of magnets embedded within the base structure. These magnets generate a magnetic field, which allows the fan to firmly adhere to ferrous or metallic surfaces like steel desks, I-beams, metallic structures (construction buildings, scaffolding, etc.) shelves, work benches, scissor lifts, car lifts, or other objects composed of magnetic materials or some combination thereof.

The strength of the magnets is designed to ensure a strong hold, preventing the fan from slipping or falling when attached to such surfaces. The magnetic base offers convenience and flexibility in placement, as it eliminates the need for additional clamps, screws, or other mounting hardware. Users may easily reposition the fan by detaching and reattaching it to various magnetic surfaces without any tools, making it suitable for different environments. Additionally, the design of the magnetic base, in at least one embodiment, may include a protective covering or non-slip material to prevent scratches or damage to the surface it's attached to, ensuring both a secure grip and surface protection. The utilization of a magnetic base in fans enhances their versatility, allowing users to place the fan in various locations, adjust angles for optimal airflow, and improve usability in different settings without compromising stability or requiring complex installation procedures.

In some aspects, the device described herein relates to an adjustable fan, wherein the adjustable support structure is made of a flexible, yet resilient material. The adjustable support structure in a fan plays a role in providing flexibility and customization regarding the fan's positioning and airflow direction. This component is designed to be adaptable and easily modifiable to suit user preferences. The structure consists of multiple articulated segments made from resilient materials such as sturdy plastics, flexible metals like aluminum alloys, or sometimes reinforced rubber. These materials offer durability and flexibility, allowing the support structure to maintain its shape while also being adjustable and bendable.

Each segment in the support structure is connected through joints or hinges, enabling users to bend, rotate, or reposition the fan head in various angles and orientations. This flexibility allows for a wide range of adjustments, letting users direct airflow precisely where needed, whether it's to cool a specific area, redirect airflow away from obstacles, or optimize comfort in different settings. For example, when welding, smoke and other airborne debris/pollutants are generated and desired to be blown away from the worker. This allows for a clear view of the working surface as well as limiting/preventing whether such smoke and other pollutants are breathed in by the worker.

The resilient nature of the materials used ensures that the support structure retains its shape after adjustments, providing stability and reliability during use. This feature allows users to confidently position the fan without concerns about sagging or drooping of the support structure over time. Moreover, the adjustable support structure enhances the fan's versatility, making it suitable for various environments and applications. It enables users to adapt the fan to different spaces, such as desks, construction buildings, work benches, scissor lifts, workstations, bedside tables, or even outdoor settings, by adjusting the fan's orientation and airflow direction to meet specific needs. Overall, the adjustable support structure's design and material composition offer users the ability to customize the fan's position and airflow direction, providing convenience, adaptability, and efficient air circulation tailored to individual preferences and requirements.

In some aspects, the device described herein relates to an adjustable fan, further including, one or more sensors, the one or more sensors are electrically connected to the power source. The integration of one or more sensors into the adjustable fan marks an advancement in its functionality. These sensors, connected electrically to the fan's power source, serve to enhance the fan's responsiveness and adaptability to environmental conditions or user requirements. By incorporating sensors such as temperature sensors, smoke detection sensors, humidity sensors, motion sensors, air quality sensors, or timer sensors, the fan gains the ability to collect real-time data from its surroundings.

This data empowers the fan's control system to make informed decisions about its operation, enabling automatic adjustments based on the sensor inputs. For example, temperature sensors allow the fan to regulate its speed or airflow direction based on changes in room temperature, ensuring optimal comfort. Humidity sensors enable adjustments to maintain an appropriate level of moisture in the air. Motion sensors might trigger the fan to turn on or off depending on detected movement in the room, contributing to energy efficiency. Smoke detectors may be configured to generate an alarm signaling the presence of certain harmful airborne particulates or increase a speed of the fan to help remove smoke and other airborne pollutants away from a user of the fan.

The electrical connection of these sensors to the power source facilitates seamless communication between the sensors and the fan's control circuitry. This connection enables the fan to process sensor data and execute appropriate actions, providing a more intelligent, efficient, and user-friendly experience.

In some aspects, the device described herein relates to an adjustable fan wherein the one or more sensors include a thermometer. The integration of a thermometer sensor in the adjustable fan adds valuable functionality by allowing the fan to monitor ambient temperature in its surroundings. Thermometer sensors incorporated into the fan's design measure the temperature of the air or the immediate environment where the fan is placed.

The thermometer sensor provides real-time temperature data to the fan's control system. This data enables the fan to make intelligent decisions regarding its operation, such as adjusting fan speed, altering airflow direction, or activating specific cooling or heating modes based on the detected temperature changes. For instance, when the thermometer sensor detects rising temperatures in the room, the fan's control system can increase the fan's speed or reposition the airflow to provide more cooling. Conversely, if the temperature decreases, the fan may adjust its settings to provide gentle or indirect airflow to maintain a comfortable environment. Integrating a thermometer sensor into the fan's functionality not only enhances user comfort by regulating the ambient temperature but also contributes to energy efficiency by allowing the fan to operate more intelligently based on the detected temperature conditions.

In some aspects, the device described herein relates to an adjustable fan wherein the one or more sensors include a smoke detection sensor. The smoke detection sensor may be as one generally known in the art. For example, an ionization smoke detector utilizes a small amount of radioactive material between two electrically charged plates, which ionizes the air and causes current to flow between the plates. When smoke enters the chamber, it disrupts the flow of ions, thus reducing the flow of current and activating the sensor. In another embodiment, a photoelectric sensor may be used to aim a light source into a sensing chamber at an angle away from the sensor. Smoke enters the chamber, reflecting light onto the light sensor; triggering the sensor. Other smoke detection sensors and capabilities may also be contained under the purview of the present invention.

Figure 4:
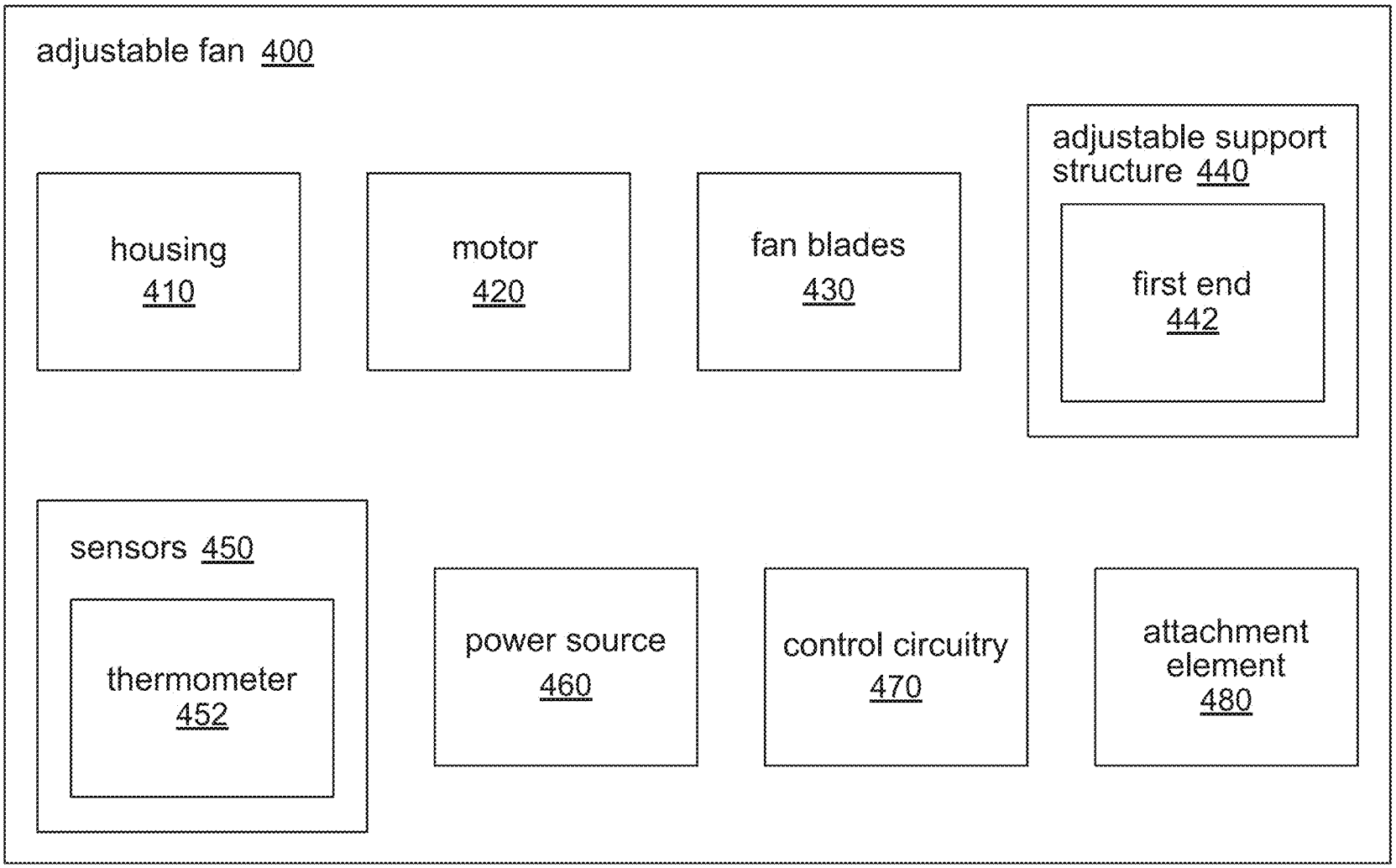
FIG. 4 is a block diagram illustrating an adjustable fan, according to some embodiments of the present disclosure.

FIG. 4 is a block diagram that describes an adjustable fan 400, according to some embodiments of the present disclosure. In some embodiments, the adjustable fan 400 may include a housing 410, a motor 420, an adjustable support structure 440, and an attachment element 480 configured to removably connect to an object. The adjustable fan 400 may also include a plurality of fan blades 430, the plurality of fan blades 430 retained in the housing, at least a portion of the plurality of fan blades 430 communicatively coupled to the motor 420. The adjustable fan 400 may also include one or more sensors 450, the one or more sensors 450 may be electrically connected to the battery/power source 460. The adjustable fan 400 may also include control circuitry 470 electrically connected to the battery/power course 460. The adjustable support structure 440 may include a first end 442 connected to the housing located opposite a second end connected to the battery/power course 460. The one or more sensors 450 may include a thermometer 452. The adjustable support structure 440 may be made of a resilient material. The attachment element 480 may be a magnet.

In some embodiments, there may be a light element positioned on the housing of the fan. The light element may be known light elements such as light emitting diodes or another suitable light emitting device. The light element may vary in position and number. It may be appropriate to enable multiple light elements to turn on and off independently or in groups. Further, the light elements may be capable of being articulated thereby allowing the direction of the light emitted to be modified by a user of the fan. In a preferred embodiment, a light element is configured to emit light in a direction of the airflow generated by the fan. This allows for the area in which the fan is removing or blowing away smoke, debris, and the like to be illuminated by the light element.

It is also to be understood that the description is intended to cover all of the generic and specific features of the invention herein described, and all statements of the scope of the invention that, as a matter of language, might be said to fall therebetween.

It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An adjustable fan, comprising:

a housing;

a motor;

a battery;

a plurality of fan blades, the plurality of fan blades retained in the housing, at least a portion of the plurality of fan blades communicatively coupled to the motor;

a flexible support structure having a first end connected to the housing located opposite a second end connected to the battery;

one or more sensors coupled to the battery, wherein the one or more sensors comprise a timer and a smoke detection sensor, wherein the smoke detection sensor is configured to cause a change in operative status of the adjustable fan in response to smoke being detected by the smoke detection sensor; and a magnetic base having one or more magnetic elements, the magnetic base being directly affixed to a bottom surface of the battery.

2. The adjustable fan of claim 1 wherein the battery is a lithium-ion battery.

3. The adjustable fan of claim 1 wherein the battery is rechargeable.

4. The adjustable fan of claim 1 wherein the one or more sensors further comprise a temperature sensor.

5. The adjustable fan of claim 1 wherein the smoke detection mechanism is an ionization smoke detector or a photoelectric smoke detector.

6. The adjustable fan of claim 1 wherein the at least one magnetic element is embedded in a magnetic base.

7. The adjustable fan of claim 1 wherein when the smoke detection sensor senses a presence of smoke, then adjustable fan is configured to increase in a rate of rotation of the plurality of fan blades.

8. The adjustable fan of claim 4 wherein the temperature sensor is configured to monitor a temperature of an environment of the adjustable fan and modify an operation of the adjustable fan in response to the temperature of the environment.

9. The adjustable fan of claim 8 wherein a modification of the operation of the adjustable fan includes adjusting a rate of rotation of the plurality of fan blades, modifying a direction of airflow, or activating a heating or cooling mode, or a combination thereof.

10. The adjustable fan of claim 1 wherein the timer monitors or tracks an amount of elapsed time during operation of the adjustable fan.

* * * * *